United States Patent [19]

Laven

[11] 3,938,199

[45] Feb. 17, 1976

[54] SWIMMING POOL COMPONENTS

[76] Inventor: Merrill L. Laven, 4 Marion Ave., Albany, N.Y. 12203

[22] Filed: Dec. 27, 1973

[21] Appl. No.: 428,882

[52] U.S. Cl. ..... 4/172.19; 52/169 R; 52/282; 52/288; 52/309; 52/495; 52/588

[51] Int. Cl.[2]... E04H 3/16; E04H 3/18; F16L 21/02

[58] Field of Search..... 4/172, 172.19, 172.21, 4/173, 1; 52/169, 282, 288, 309, 495, 588

[56] References Cited

UNITED STATES PATENTS

| | | | |
|---|---|---|---|
| 3,100,556 | 8/1963 | DeRidder | 52/588 |
| 3,190,408 | 6/1965 | Patterson | 52/282 X |
| 3,192,538 | 7/1965 | Walter | 52/495 X |
| 3,264,020 | 8/1966 | DeRidder | 52/495 X |
| 3,292,325 | 12/1966 | Nicolini | 52/282 X |
| 3,396,500 | 8/1968 | Lankheet | 52/169 |
| 3,416,165 | 12/1968 | Pereira | 4/172.19 |
| 3,458,875 | 8/1969 | Michalke et al. | 4/172.19 |
| 3,564,791 | 2/1971 | Arp | 52/169 |
| 3,605,363 | 9/1971 | Bard | 52/241 |
| 3,720,964 | 3/1973 | Thomson | 4/172.19 |
| 3,736,599 | 6/1973 | Kessler et al. | 4/172.19 |
| 3,739,539 | 6/1973 | Posnick | 52/169 |
| 3,797,049 | 3/1974 | DeSanto | 4/172.19 |
| 3,801,993 | 4/1974 | Stalder | 4/172.19 |

*Primary Examiner*—Henry K. Artis
*Attorney, Agent, or Firm*—Steinberg & Blake

[57] ABSTRACT

A swimming pool which has a plastic liner sheet having an inner surface directed toward the interior of the pool to define the interior thereof and an outer surface directed away from the interior of the pool. A plastic backing structure which is rigid engages the outer surface of the liner sheet so as to form a backing for the latter. The plastic backing structure takes the form of a plurality of units situated one next to the other along the periphery of the pool with each of these units being composed of a series of extrusions situated one next to the other. Each of the extrusions is hollow and has front and rear parallel walls interconnected by strips which are situated one above the other between these walls.

38 Claims, 22 Drawing Figures

FIG. 1
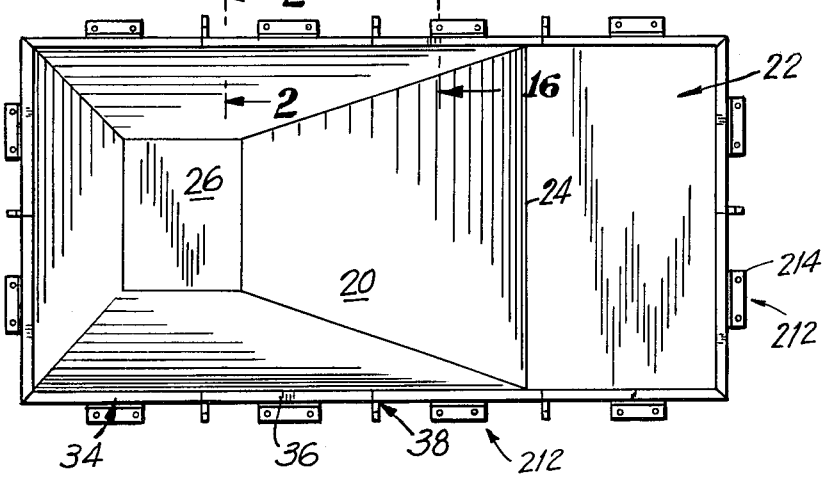
FIG. 2
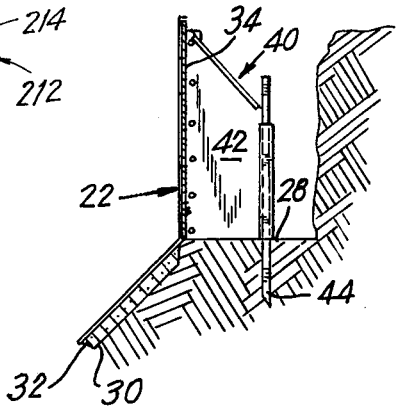
FIG. 3
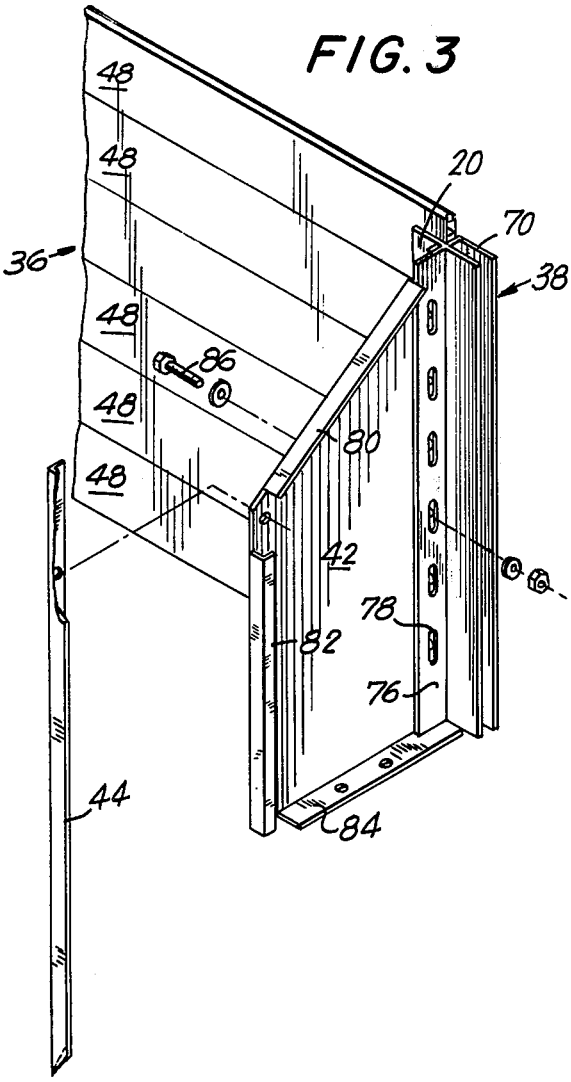
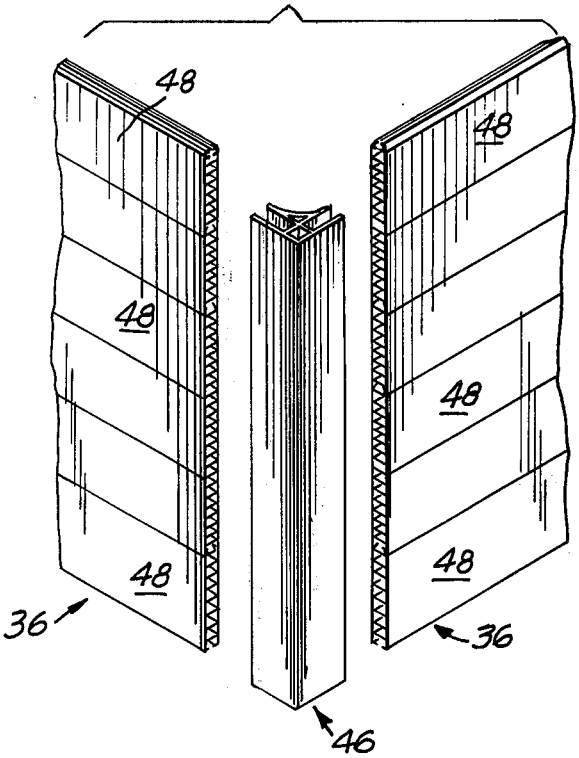
FIG. 4

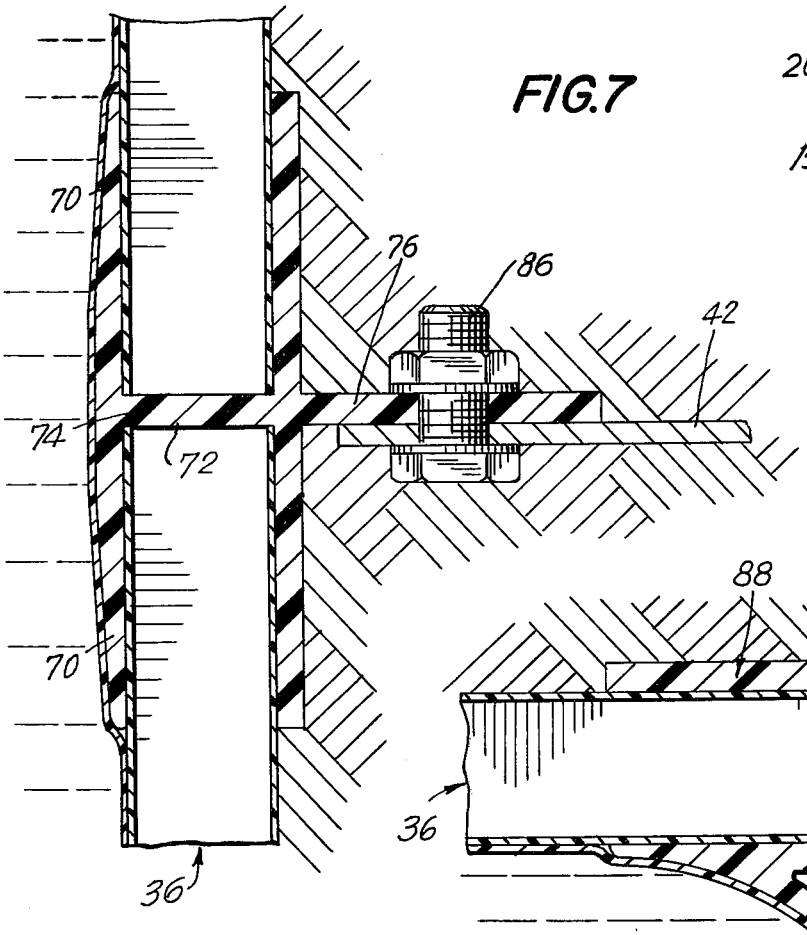
FIG.7
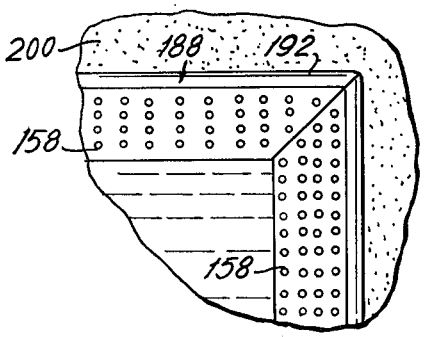
FIG.15
FIG. 8
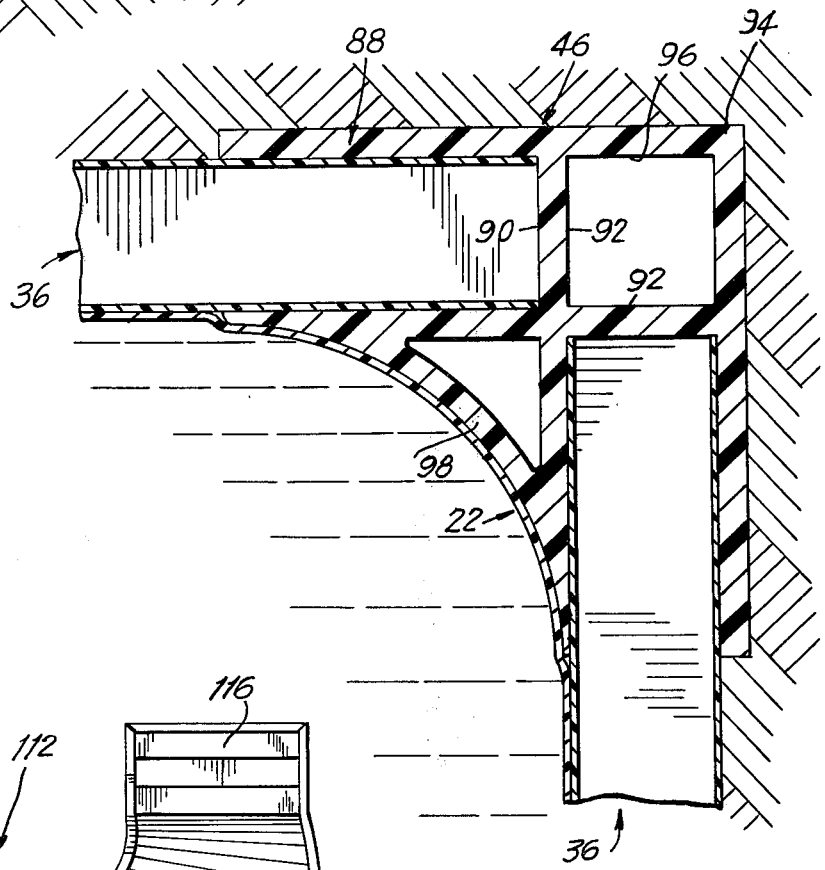
FIG. 9
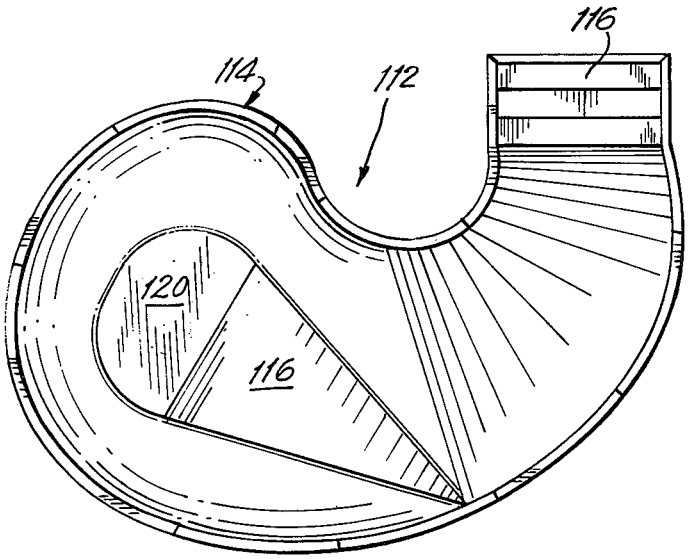

FIG.10
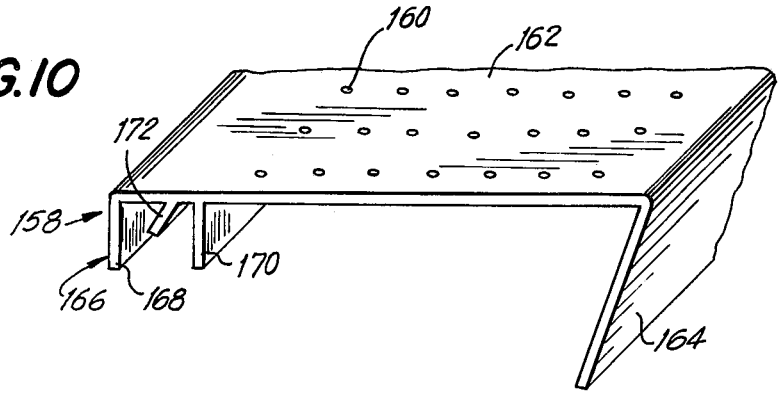
FIG.11
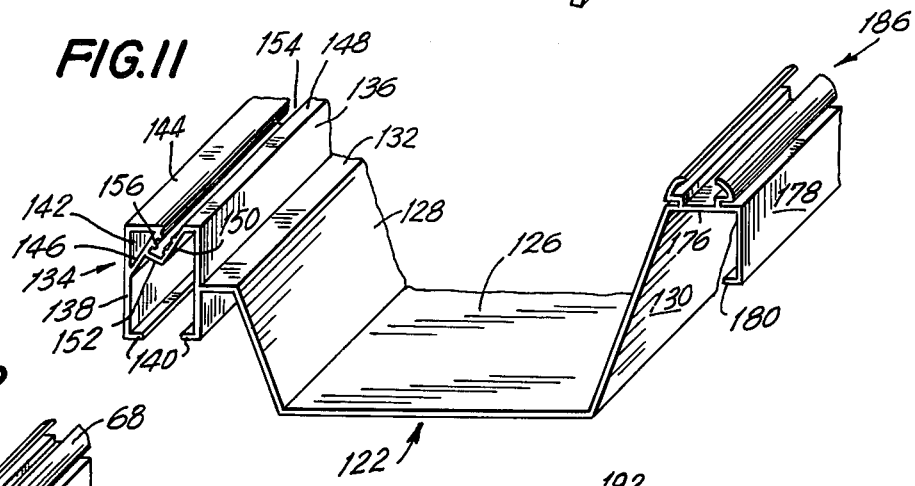
FIG.12
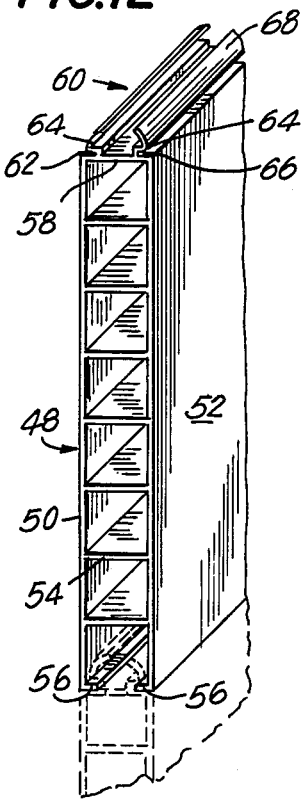
FIG.13
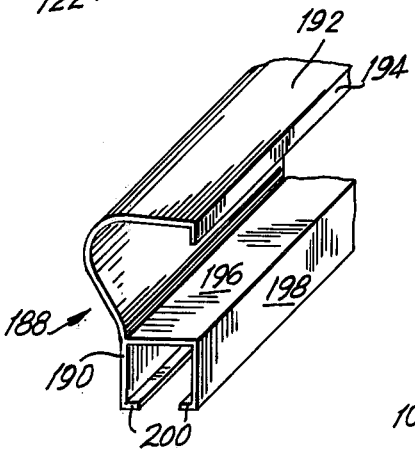
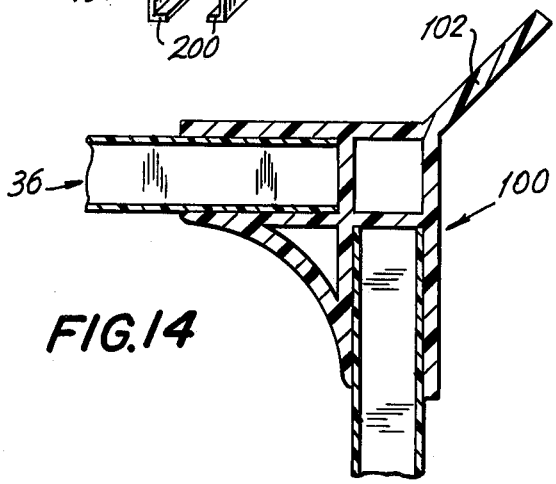
FIG.14

SWIMMING POOL COMPONENTS

BACKGROUND OF THE INVENTION

The present invention relates to swimming pools.

In particular, the present invention relates to components which may be assembled together to form at least part of a swimming pool.

It is conventional at the present time to construct swimming pools in such a way that a plastic sheet, such as a vinyl sheet, defines the interior of the pool. It is conventional to support such a sheet at its lower region directly on the ground at a part of the ground which has been hollowed out for this purpose, the hollowed out part of the ground being initially lined with mason sand, for example, so as to have a relatively smooth surface on which the plastic sheet rests at its lower region. The upper vertically extending part of the plastic sheet, however, must be a supported by a suitable backing structure, and for this purpose it is conventional to use metal backing sheets which are suitably anchored and which are provided at their upper regions which a structure to which the top of the vinyl sheet can be connected.

Conventional structures of this latter type have several disadvantages. Thus, while the plastic sheet presents no particular problem since it can be readily folded into a compact unit for shipping purposes and can easily be unfoled and spread out at the site of the pool, the other structure of the pool does not have these conveniences and advantages. For example the metal backing sheets must be fabricated in the form of large flat sections which are very heavy and difficult to transport and handle during setting up of the pool. Furthermore, it is difficult to connect the top edge of the plastic sheet to the metal backing elements in a fluid-tight manner. The result is that water will sometimes flow from the pool to a location between the plastic sheet and the metal backing, creating in this way a faulty pool. The access of water to the rear or outer surface of the plastic sheet must be avoided, and it is not always possible to prevent the water from having access to the outer surface of the plastic sheet with conventional constructions.

Furthermore, inconveniences and problems are encountered with respect to circulation of the pool water for filtering purposes. Constructions of the above type composed of a plastic sheet and a metal backing therefor do not lend themselves to use of an overflow gutter. Therefore it is customary with such constructions to provide an opening in the side of the pool for attachment of a skimmer installation through which water can flow out of the pool to be filtered before being returned to the pool. The attachment of such a skimmer installation itself creates problems because of the complexity of such installations and the inconvenience in connection with the attachment thereof to the metal pool wall.

A further problem encountered with conventional pool constructions of the above type resides in the fact that the variety of pool configurations is limited. Thus, the metal backing sheets are relatively thick sheets of steel which do not lend themselves to curving to the desired extent, so that as a result such backing sheets remain straight, necessitating pools of polygonal configuration composed of straight sections which are angularly adjoined one to the next. While such steel backing sheets are flexible to some extent, it is only with extreme difficulty that it is possible to curve these sheets to the desired extent in order to obtain curved pools. As a result pools of this general type of necessity have relatively sharp corners which are not always desirable.

SUMMARY OF THE INVENTION

It is accordingly a primary object of the present invention to provide swimming pool components which can be assembled to form a pool of practically any desired configuration while at the same time avoiding the drawbacks referred to above.

More specifically, it is an object of the present invention to provide a swimming pool with a sheet backing structure composed of a plastic material so that a relatively light-weight backing structure which can be easily shipped is achieved.

Furthermore, it is an object of the present invention to provide a backing structure of the above type which can be broken down into small light units which can be easily shipped in a compact manner to any desired location, with these units being fabricated easily and inexpensively and being easily handled both for shipping purposes and for setting up the pool.

Furthermore it is an object of the present invention to provide a pool construction which will reliably prevent any water from reaching the outer surface of the plastic sheet.

In addition it is an object of the present invention to provide a pool construction of the above type which can conveniently be associated with a gutter assembly into which the pool water can overflow so that the inconveniences in connection with skimmer installations can be avoided.

Also it is an object of the present invention to provide a pool construction which lends itselt to use tieh a concrete deck.

In addition it is an object of the present invention to provide a pool construction where practically all of the components, except for the plastic sheet and some anchoring elements, can conveniently and inexpensively be manufactured from plastic extrusions, so that the pool can be assembled of light-weight inexpensive parts.

Furthermore, it is an object of the present invention to provide swimming pool components which can easily be fabricated in curved configurations enabling swimming pools of any desired curvature and configuration to be manufactured inexpensively.

According to the invention the swimming pool includes an inner plastic liner sheet having an inner surface directed toward and defining the interior of the pool and an outer surface directed away from the interior of the pool. A plastic backing means which is rigid engages the outer surface of the sheet so as to form a backing for the latter.

The plastic backing means includes a plurality of units situated one next to the other along the periphery of the pool. Each of these units is made up of a series of elongated extrusions situated one next to the other. Each of these extrusions has an inner vertical wall engaging the outer surface of the liner sheet and an outer vertical wall which is parallel to and spaced from the inner wall, each extrusion having a plurality of strips situated between and integrally joined with the inner and outer walls. In this way although each hollow extrusion is of a relatively light weight nevertheless it is provided with the required strength and rigidity, and at the same time these extrusions can be manufactured at relatively low cost.

BRIEF DESCRIPTION OF DRAWINGS

The invention is illustrated by way of example in the accompanying drawings which form part of this application and in which:

FIG. 1 is a top plan view of one possible embodiment of a pool according to the invention, FIG. 1 showing the pool without the gutter and outer deck which surrounds the pool;

FIG. 2 is a schematic vertical section taken along line 2—2 of FIG. 1 in the direction of the arrows illustrating how the backing means are anchored and braced;

FIG. 3 is a fragmentary perspective partly cxploded view of part of a unit of a backing means and the anchoring structure of FIG. 2 as well as the structure for connecting a pair of units of the backing means one to the next;

FIG. 4 is a fragmentary perspective exploded view of a pair of backing units forming a corner of a pool with a connector means shown between these units;

FIG. 7 is a fragmentary sectional plan view taken along line 7—7 of FIG. 6 in the direction of the arrows ans showing how a pair of successive units of the backing means are joined to each other as well as illustrating how the bracing an anchoring is constructed;

FIG. 8 is a fragmentary sectional plan view of a corner of the pool of the invention, FIG. 8 illustrating how the parts shown in FIG. 4 cooperate;

FIG. 9 is a top plan view of a further possible configuration of a pool according to the invention;

FIG. 10 is a fragmentary perspective illustration of a cover means for a gutter as well as part of a connecting means for the top of the plastic sheet;

FIG. 11 is a fragmentary perspective illustration of an extrusion forming a gutter and the remainder of the sheet-connecting means which cooperates with part of the structure of FIG. 10;

FIG. 12 is a fragmentary perspective illustration of one of the extrusions of a unit of a backing means, with part of the next-lower extrusion shown in phantom lines;

FIG. 13 is a fragmentary perspective illustration of a concrete retainer means capable of being assembled with the upper outer portion of the gutter extrusion of FIG. 11;

FIG. 14 ia a fragmentary sectional plan view of a corner connector means different from those illustrated in FIGS. 4 and 8;

FIG. 15 is a fragmentary top plan view of a corner of the finished pool illustrating the miter connection which may be utilized.

DESCRIPTION OF PREFERRED EMBODIMENTS

Figures 5, 6:
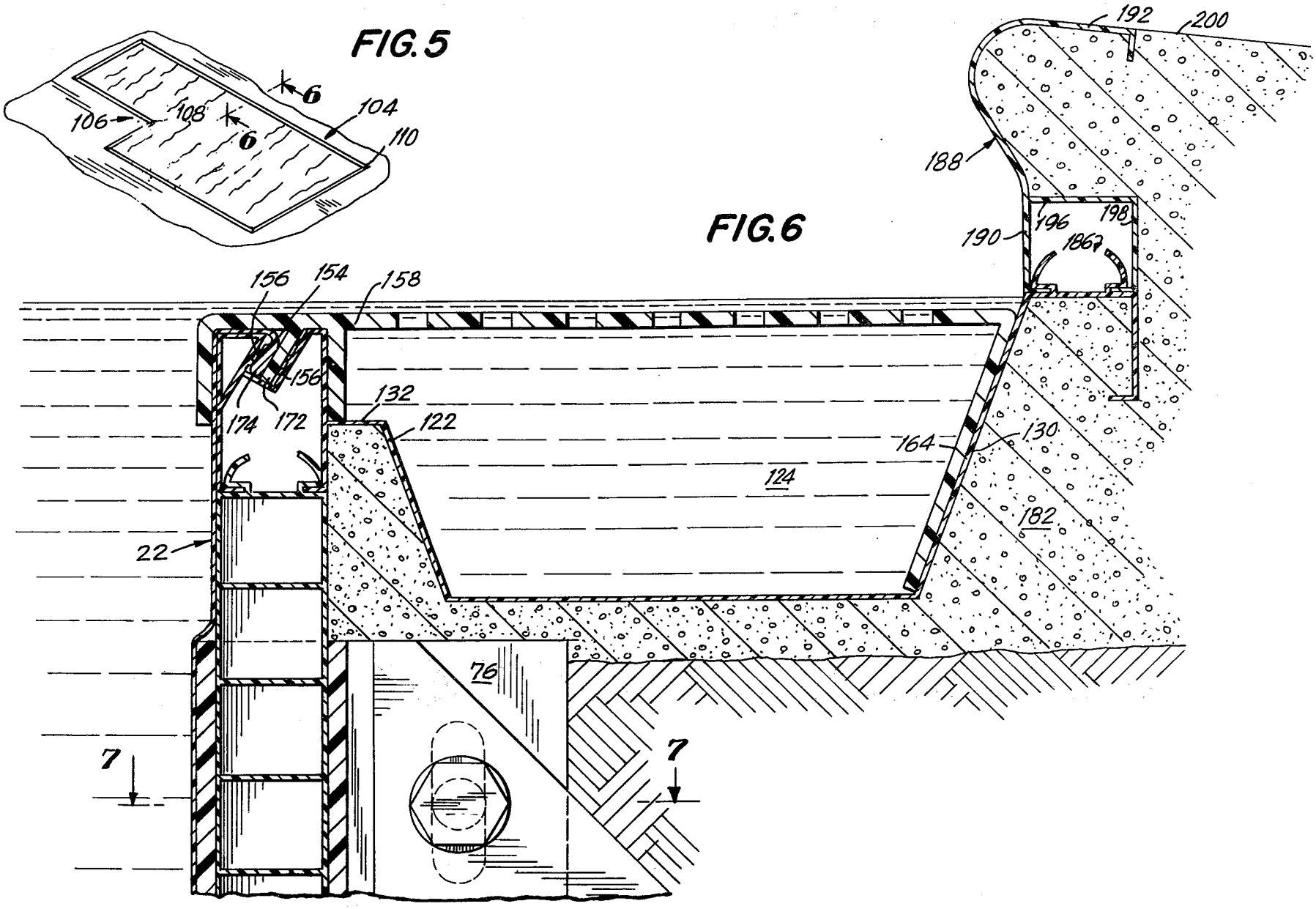
FIG. 5 is a fragmentary perspective illustration of a pool having a configuration different from that of FIG. 1.
FIG. 6 is a fragmentary vertical sectional view taken along line 6—6 of FIG. 5 in the direction of the arrows and showing at a scale which is considerably enlarged as compared to FIG. 5 the manner in which various components of the invention are assembled and supported on the ground as well as connected with a surrounding concrete deck.

Referring first to FIGS. 1 and 2, there is schematically illustrated therein one possible pool construction in accordance with the invention with the parts shown in FIGS. 1 and 2 at a necessarily reduced scale. The details of the components of FIGS. 1 and 2 are described in greater detail below and shown in greater detail in other figures. Furthermore, for the sake of simplicity FIGS. 1 and 2 only show that part of the pool which includes the plastic liner sheet, the backing means for the lining sheet, and the anchoring means.

Thus, referring to FIG. 1, there is illustrated therein in a top plan view the interior of the pool, this interior being defined by the inner surface 20 of a plastic liner sheet 22 made of any suitable plastic such as a suitable vinyl. This plastic liner sheet lines the entire interior of the pool and is adapted to be substantially filled with water. The shallow end of the pool is shown at the right portion of FIG. 1 which extends from the right end of the pool, as viewed in FIG. 1, up to the line 24. From the line 24 toward the left, as viewed in FIG. 1, the pool becomes gradually deeper until it reaches the deepest portion 26, and from this deepest portion the sides of the pool are inclined outwardly and upwardly as illustrated.

In order to construct such a pool the ground is hollowed out all around the pool in the manner illustrated in FIG. 2. Thus, the outer periphery of the hollowed out part of the ground is provided with a horizontal surrounding ledge 28 and then at the inner periphery of the ledge 28 the ground is further hollowed out, as shown at 30 in FIG. 2 in order to provide the deeper part of the pool shown to the left of the line 24 in FIG. 1. In order to provide a proper supporting surface for the plastic liner sheet 22 the ground is spooned out with mason sand 32 as indicated fragmentarily in FIG. 2. The ledge 28 will have a configuration conforming to the outer peripheral configuration of the pool, an all along the inner edge of the ledge 28 is located the backing means 34 of the present invention. This backing means 34 backs the outer vertical surface portion of the sheet 28 at the location where the sheet 28 extends upwardly beyond the elevation of the ledge 28. Downwardly beyond this elevation the sheet is fully supported by the mason sand 32 in order to provide the deeper portion of the pool shown to the left of the line 24 in FIG. 1. Thus, the sheet 22 is shown schematically in FIG. 2 extending upwardly from the deeper part of the pool along the inner surface of the backing means 34 and slightly overlapping the upper part of the backing means.

The backing means 34 includes a series of units 36 situated one next to the other along the periphery of the pool and joined by connector means 38 schematically illustrated in FIG. 1. The several connector means 38 are shown at the straight sides of the pool, and additional unillustrated connector means are located at the corners of the pool as described below in connection with FIGS. 4 and 8. Each connector means 38 is fixed with an anchoring means 40 which includes a stiff metal sheet structure 42 and an anchoring stake 44 shown schematically in FIG. 2. After the pool has been set up in the manner shown schematically in FIGS. 1 and 2, the earth will be filled in around the anchoring means 40 and up to the outer surface of the backing means 34, and then on the ground there will be situated a suitable concrete deck, for example, as described in greater detail below.

One of the units 36 of the backing means 34 is fragmentarily illustrated in FIG. 3, while a pair of the units 36 situated as a corner of the pool are fragmentarily illustrated in FIG. 4. The successive units 36 are interconnected by the connector means 38 which is shown more clearly in FIG. 3, with a corner connector means 46 being shown in FIG. 4. Each of the units 36 is made up of a series of elongated extrusions 48 situated one above the other at each unit 36 and connected one to the next in a manner described in greater detail below. Referring to FIG. 12, the details of each extrusion 48 are illustrated therein. Thus each extrusion 48 has an inner wall 50 which extends vertically and a parallel vertical outer wall 52 which is spaced from the inner wall 50. This inner wall 50 engages the outer surface of the plastic liner sheet 22, while the inner surface of the latter of course defines the interior of the pool which receives the water. The parallel walls 50 and 52 of the plastic extrusion 48 are interconnected by a series of horizontal strips 54 situated one above the other between the walls 50 and 52 and extending perpendicularly to these walls, these strips 54 being extruded simultaneously with the walls 50 and 52 so as to be integral therewith.

Beneath the lowest strip 54 the walls 50 and 52 terminate in a pair of inwardly directed flanges 56 which are spaced from each other as illustrated at the lower part of FIG. 12. The uppermost one of the series of parallel horizontal strips 54 forms an upper end strip 58 of the extrusion 48. This upper end strip 58 is integrally extruded with a connecting means 60 which forms a springy connecting means to interconnect each extrusion 48 with the next higher extrusion. The springy connecting means 60 includes a pair of vertical ribs 62 which extend upwardly from and are integrally extruded with the upper end strip 58. The springy connecting means 60 further includes a pair of outwardly directed flanges 64 which are integral with the ribs 62 and project horizontally outwardly from the space between the ribs 62. Thus the flanges 64 define with the upper end strip 58 a pair of grooves 66. The outer edges of the horizontal flanges 64 are integrally formed with a pair of upwardly and inwardly curved tongues 68. Thus, this entire structure of the extrusion 48 is extruded in one piece of a suitable plastic through a suitable extrusion die, and from the die a structure as shown fragmentarily in solid lines in FIG. 12 continuously issues to be cut in suitable lengths. Thus, these lengths will correspond to the distance between the successive connector means 38. Solely by way of example, the extrusions 48 may each have a total height on the order of seven or eight inches, and the extrusion issuing from the extruder may be cut into lengths of six feet, for example. However it is to be understood that the extrusions may have any desired length while the height of the extrusions can also vary considerably.

Extrusions as described above, while being of an extremely light weight are nevertheless very strong and rigid as a result of the horizontal strips 54 which extend between the inner and outer walls 50 and 52. Because these extrusions are cut into the desired lengths and are of a relatively small height, they can easily be packed so that shipping can be carried out in an extremely convenient manner. At the site of the pool, the series of extrusions 48 which will form a single unit 36 will be assembled together simply by snapping one extrusion 48 onto the next lower extrusion. Thus, the inwardly directed flanges 56 at the lower end of one extrusion 48 will be pressed downwardly against the upper convexly curved surfaces of the springy tongues 68 to deflect the latter inwardly toward each other into the space between the flanges 56. As soon as the lower edges of the tongues 68 move upwardly beyond the inner edges of the flanges 56, these tongues snap out so that the flanges 56 of one extrusion become reliably situated in the grooves 66 of the next lower extrusion. Through this construction it is possible without the use of any tools to quickly assemble the desired number of extrusions together in order to form a unit 36. FIG. 12 shows in phantom lines part of an extrusion 48 which is situated below the extrusion 48 which is fragmentarily shown in solid lines in FIG. 12.

At the site the several extrusions 48 of each unit 36 are assembled together, and of course these extrusions 48 are of equal lengths so that the ends of the extrusions of a given unit 36 of the backing meand 34 will all be lined up with each other. The several units 36 are mounted in an erect position at the region of the inner edge of the ledge 28. The successive units 36 are held together by the plurality of connector means 38. Thus, referring to FIGS. 3 and 7, each connector means 38 has a pair of channels 70 which respectively receive the ends of adjoining units 36 with a snug fit. Each channel 70 has a pair of opposed side walls defining between themselves the space which receives an end region of a unit 36, and transverse surfaces 72 extend between the inner surfaces of these side walls of each channel 70. The units 36 are introduced into the channels all the way up to the transverse surfaces 72. In the example of a connector means 38 which is illustrated in FIGS. 3 and 7, the pair of channels 70 are interconnected by a common wall 74 the opposed surfaces of which form the pair of inner surfaces 72 of the pair of channels 70 shown in FIG. 7. The height of each unit 36 can be somewhat greater than the length or height of each connector means 38 so that the uppermost extrusion 48 of each unit 36 will extend somewhat higher than each connector means 38, and if desired these uppermost extrusions 48 can be made slightly longer than the others and provided with shoulders the length of which is equal to half the thickness of the common wall 74, wo that at the place where the upper extrusions 48 project upwardly beyond the connector means 38, the upper extrusions of a pair of adjoining units will butt against each other. The lower flanges of the lowermost extrusion 48 can directly engage the ledge 28.

Each connector means 38 is provided with an outwardly directed integral flange 76 situated in the same plane as and forming a continuation of the common wall 74. This flange 76 extends throughout the entire height or length of each connector means 38. The connector means 38 are also in the form of plastic extrusions. Thus suitable plastic material is extruded through a suitably shaped die so as to form an extrusion which is cut into the required lengths for forming the several connector means 38.

The flange 76 is punched through so as to be formed with a series of elongated openings 78, and these openings 78 may be formed either before or after the extruded material is cut into the lengths which form the plurality of connector means 38.

The anchoring means 40 is connected to each connector means 38 at the flange 76 thereof. This anchoring means 40 includes the relatively strong metal sheet 42 shown in FIG. 2 and illustrated in greater detail in FIG. 3. This sheet which may be made of steel, for example, has an upper inclined edge provided with a flange 80, and at its outer edge it has a flange 82 which in effect forms an angle iron integral with the sheet 42 so as to define therewith an elongated channel capable of receiving the vertically extending stake 44 which is itself in the form of an angle iron. This stake is of course provided with a lower pointed end so that it can readily penetrate into the ground. The lower end of the sheet 42 has a horizontal flange 84 which may rest on a suitable supporting plate structure if desired, although it may also rest directly on the ground at the ledge 28. The upper inclined flange 80 is cut at one end so that the flange 76 of the connector means 38 can be located directly next to the sheet 42, and this sheet is formed with openings which will become aligned with the elongated openings 78 so tht bolt-and-nut assemblies 86 can be passed through the openings of the sheet 42 and through the openings 78 in order to fix the anchoring means 40 to each connector means 38. Thereafter, the stake 44 is driven down through the channel which is formed by the angle iron 82, and the flanges 80 and 84 are suitably cut so as to enable the stake 44 to move downwardly across the outer ends of these flanges. One wall of the angle iron 44 may have one or more openings to be aligned with one or more openings formed in the sheet 42, as schematically shown in FIG. 3, so that suitable bolts may also pass through the anchoring structure at this location. In this way each connector means 38 is reliably anchored to the ground and the backing means 34 is held in a fixed position.

The pair of units 36 which join each other at each corner of the pool are connected together by a connector means 46 in the same way as described above in connection with FIGS. 3 and 7, except that in this case the pair of units 36 are perpendicular to each other. Thus, for this purpose each corner connector means 46 has a pair of channels 88 which are at right angles to each other and which are defined by a pair of channel walls defining the spaces which receive the ends of the units 36 as indicated in FIGS. 4 and 8. The opposed walls of each channel 88 are interconnected at their inner surfaces by transverse inner surfaces 90 against which the ends of the adjoining units 36 are placed. However, in this case the inner surfaces 90 form parts of a pair of separate walls 92 which are integral and perpendicular to each other. Moreover, the outer walls of the channels 88 have extensions which intersect to form a corner 94, so that in this way the corner connector means 46 has a hollow tubular section 96. Moreover, the inner walls of the channels 88 are interconnected by a fillet wall 98. In this way a smooth transition is provided for the liner sheet 22 at the region where it extends between a pair of vertical wall portions of the pool, as indicated most clearly in FIG. 8. It is to be noted that FIG. 7 also shows how the liner sheets 22 engages the inner surface of the connector means 38 and the adjoining inner surfaces of the units 36.

It is to be noted that the corner connector means 46 is also made of plastic and is in the form of an extrusion. Thus, the extruded material which issues to form a corner connector means 46 is cut into suitable lengths so as to form a corner connecting means 46 having the height which is illustrated, for example, in FIG. 4.

Referring to FIG. 14, there is illustrated a corner connector means 100 which is identical with the corner connector means 46 described aove and shown in FIGS. 4 and 8, except that the corner connector means 100 has integrally extruded with the remainder of its structure an outwardly extending flange 102 which corresponds to the flange 76 of the connector means 38 and which can be joined in the same way with an anchoring means 40. However, depending upon the conditions encountered at a given location, it may be preferred to use connector means 46 without the anchoring structure. In this connection reference is made to FIG. 5 which shows a finished pool 104 which has all of the features described above except that this pool 104 has a jog 106 providing the pool with an inwardly directed corner 108 in addition to the outwardly directed remaining corners 110. At any of the corners 110 it is possible to select between the connector means 46 or the connector means 100. However, at an inside corner 108 as shown in FIG. 5 a connector means 46 must be used since the flange 102 of FIG. 14 cannot be accommodated at an inwardly facing corner 108.

One of the advantages achieved with the structure of the present invention resides in the fact that there is practically no limitation on the configuration of the pool. Thus, it happens that FIGS. 1 and 5 show pools made up exclusively of straight elongated portions which join each other at right-angle corners. However, the corners, if they are present, can have any desired angle, requiring only connector means as shown, for example, in FIG. 8, with the pair of channels at an angle with respect to each other which is different from a right angle. For this purpose the extrusion die is suitably formed so as to situate the pair of channels which receive the units 36 at the desired angle with respect to each other.

Furthermore, it is equally possible to provide pools of any desired curvature, as illustrated in FIG. 9. Thus it will be noted from FIG. 9 that the illustrated pool has a substantially kidney-bean configuration. The pool 112 of FIG. 9 is made up of a series of suitably curved units 114 each of which is constructed as described above with respect to the units 36, this curved pool of FIG. 9 being provided with suitable steps 116 at its shallow end. Also the ground is hollowed out beneath the elevation of the backing units 114 so as to have an inclined portion 116 extending downwardly from the outer pointed end 118 to the deepest region 120 which is of substantially semicircular configuration. From the regions 116 and 120 the sides below the level of the backing means units 114 gradually slope outwardly and upwardly, and the several units 114 are vertically arranged as described above with respect to the units 36.

The several units 114 are interconnected by a plurality of connector means 38 precisely as described above, although at the corners situated at the entrance to the stairs 116 connectors 46 or 100 may be used. The curved units 114 are formed of a series of extrusions similar to the extrusions 48 and situated one above the next and connected together with a springy connecting means 60 as described above in connection with FIG. 12. The desired curvature of the several extrusions is achieved very easily and economically precisely because plastic extrusions are utilized. Thus, as an extrusion having the configuration of the extrusion 48 of FIG. 12 issues from the extruder die, this extrusion is sufficiently plastic to be placed against a suitable curved surface in a curved condition while the plastic of the extrusion sets so as to become rigid. Thus, advantage is taken of the fact that the plastic extrusion as it issues from the die is still sufficiently plastic to be curved in any desired manner very readily, and as the extrusion issues from the die a selected length thereof is placed against a suitable form which has the desired curvature, so that in this way when the extrusion material becomes rigid it will have a curvature as illustrated in FIG. 9 for any of the units 114. Thus, these curved rigid units are then assembled precisely in the manner described above with respect to FIGS. 3 and 12, to provide a pool as shown in FIG. 9, for example.

Irrespective of the particular configuration of the pool, it will have an upper structure as illustrated in FIG. 6. Referring to FIG. 6 it will be seen that all along the upper periphery of the pool there is a gutter formed by extrusion sections 122 having the illustrated channel-shaped configuration and joined one to the next as by butting against each other. The configuration of these channel-shaped extrusion sections 122 which form the overflow gutter 124 is shown most clearly in FIG. 11. Thus, as may be seen from FIG. 11, the channel-shaped gutter extrusion 122 has a bottom wall 126 and a pair of outwardly and upwardly inclined walls 128 and 130 which extend upwardly and outwardly from the inner and outer edges of the bottom wall 126.

The upper edge of the wall 128 is integrally extruded with an inwardly extending wall portion 132 which in turn is integrally extruded with a sheet-connecting means 134.

The sheet-connecting means 134 includes a vertical wall 136 extending perpendicularly across the wall 132 and extending parallel to an inner vertical wall 138. These walls 136 and 138 terminate at their lower edges in inwardly directed flanges 140 which are snapped into the springy connecting means 60 of the uppermost extrusion of each unit of the backing means, as shown most clearly in FIG. 6. Thus, the flanges 140 cooperate with the springy connecting means 60 in precisely the same way that the flanges 56 cooperate with the springy means of the next lower extrusion, as described above in connection with FIG. 12.

The upper region of the inner wall 138 of the sheet-connecting means 134 is in the form of an elongated hollow triangular extrusion portion 142 forming an upper wall part 144 and an inclined wall 146 extending between the wall portion 144 and the vertical wall 138. The inner wall 136 of the sheet-connecting means 134 has an inwardly extending upper wall portion 148 which is integral with an inclined wall portion 150 which is parallel to the inclined wall portion 146, these walls 146 and 150 being interconnected by a wall portion 152 which is integral with the wall portions 146 and 150 and which defines therewith a groove extending downwardly from the top wall of the connecting means 134, this top wall being formed by the portions 144 and 148. Thus, the sheet-connecting means 134 is in the form of a one-piece extrusion which is extruded integrally with the channel extrusion 122 which forms the gutter 124, and this connecting means 134 has the groove 154 which is inclined downwardly and inwardly toward the interior of the pool, as is apparent particularly from FIG. 6.

All of the above extrusions which are used to form the various components of the pool can be manufactured from any desired plastic such as polyvinyl chloride. This plastic will for the most part be rigid in the finished components. However, in accordance with a particular feature of the invention the walls 146 and 150 are extruded in a known way, with the remainder of the extrusion shown in FIG. 11, in such a way that these walls 146 and 150 have extruded therewith longitudinally extending beads 156 which although extruded integrally with the remainder of the extrusion simultaneously therewith are nevertheless of a softer material which remains resilient and yieldable. Such extrusions which have a material which in part is rigid and in part is soft and elastic are known. Thus as one of the features of the invention the extrusion which forms the connecting means 134 and the gutter channel 122 also has the elastic beads 156 as an integral part thereof. Thus a number of these beads will be located at each side of the groove 154.

The overflow gutter 124 is covered by sections of a plastic cover means 158 which also may be extruded. The cover means 158 is shown most clearly in FIG. 10. In this case also the extruded material is cut into suitable lengths which are situated one next to each other over the gutter 122 so as to cover the latter. The extruded material is however punched through with a number of openings 160 so that the overflow water can fall through these openings 160 into the gutter 124 filling the latter as shown in FIG. 6, while at the same time larger articles such as leaves, twigs, and the like, will be prevented by the openings 160 from entering into the gutter 124. This gutter 124 communicates with an unillustrated pipe system through which the water from the gutter is conveyed through a filter before being returned to the pool, a suitable pump being provided for this purpose.

The cover means 150 thus has the top wall portion 162 which is formed with the openings 160. This top wall portion 162 is integrally joined at its outer edge to an inwardly and downwardly inclined wall 164 which has the same inclination as the wall 130 and which rests against the wall 130 as illustrated in FIG. 6.

At its inner edge region the extrusion 158 is formed with a cover portion 166 which covers the upper part of the connecting means 134 and which cooperates therewith to form part of the structure for connecting the upper edge region of the plastic liner sheet 22 to the sheet-connecting means 134. For this purpose the front region 166 is in the form of a downwardly directed channel which is seated on and snugly fits against the upper part of the conneting means 134 which extends above the wall 132. Thus, the portion 166 has inner and outer walls 168 and 170 which form a channel between which the upper end of the connecting means 134 is received. Also, between these walls 168 and 170 the cover means 158 has an integral inwardly and downwardly inclined tongue 172 which extends into the groove 154 in the manner shown most clearly in FIG. 6. Thus, the extrusion 158 will be extruded in one piece so as to have the configuration shown in FIG. 10 and will be cut into suitable lengths which can be placed one next to the other along the periphery of the pool. Of course, in this case also where the pool is curved as shown in FIG. 9 the extrusions 158 will be suitably curved by being placed against suitable forms while they are still of sufficient pliability upon issuing from the extruder.

As is shown most clearly in FIG. 6, the liner sheet 22 has an upper edge region 174 in the form of a bead which is thicker than the remainder of the liner sheet 22. When the components of the pool are assembled, the sheet 22 is placed against the backing means 34, and in a known manner a suitable vacuum pipe can be applied between the sheet 22 and the backing means to extract any residual air which may remain so that the liner sheet will snugly rest against the inner surface of the backing means. The upper thicker edge 174 of the liner sheet 172 is introduced into the groove 154 all around the periphery of the pool, and then the cover means 158 is assembled with the remaining structure as illustrated in FIG. 6. The thickness of the tongue 172 is such that together with the thickness of the edge 174 of the sheet 22, the total thickness of these parts 172 and 174 is greater than the distance between the beads 156 at opposite sides of the groove 154. As a result after the thicker edge 174 of the sheet 22 is placed in the groove 154 and the tongue 172 is then introduced, the edge 174 is pressed against the left beads 156 of FIG. 6, while the tongue 172 is pressed against the right beads 156 of FIG. 6, these beads becoming deformed and compressed so that with this construction a tight connection of the sheets 22 is achieved. The tightness is achieved not only by reason of the fact that the sheet 22 snugly rests against the backing means going around the upper edge of the connecting means 134 and down into the groove 154, with the sheet being held in this manner by the front channel portion 166 of the cover means 158, but in addition an extremely effective tightness is achieved by the compression of the beads 156. As a result with this construction even though the water in the pool continuously overflows into the gutter 124 in the manner described above, it is impossible for any water to gain access to a location situated between the sheet 22 and the backing means 34, so that the possibility of any water becoming situated behind the sheet 22 with all of the problems resulting therefrom is reliably prevented.

As has been indicated above, it is possible in a very convenient manner to provide any of the pools of the invention with a concrete deck. Thus, once the structure as described above is assembled the earth which has been removed will be filled in around the structure so that an arrangement as shown in FIG. 6 will be achieved. In fact as the water is introduced and the level thereof rises up in the pool the earth is filled in so as to always be during initial setting up of the pool at least as high as the level of the water in the pool. When the earth has been filled in approximately to the height of the top ends of the flanges 76 of the plurality of connector means 38, the earth-filling or packing operations are terminated and concrete is then poured to achieve a construction as shown in FIG. 6.

For this purpose the extrusion channel 122 which forms the gutter 124 is extruded integrally with an outer horizontally extending flange 176 which in turn is integrally extruded with a downwardly extending outer wall or flange 178 terminating in an inwardly directed lower flange 180, so that in this way the gutter channel 122 will become reliably and solidly embedded in the concrete 182 when the latter solidifies after pouring. The top outer wall 176 of the single extrusion shown in FIG. 11 is integrally extruded with a springy connecting means 184 which may be identical with the springy connecting means 60 described above and shown in FIG. 12. This springy connecting means 184 serves to connect to the outer portion of the gutter channel 122 a concrete retainer extrusion 188 shown must clearly in FIG. 13. The concrete retainer means 188 has an inner wall 190 which has a lower vertical portion and an upper portion which curves inwardly and then outwardly to form the upper horizontal wall portion 192 which terminates in the downwardly and inwardly directed flange 194. As is shown most clearly in FIG. 6, the upper wall portion 192 is inclined downwardly and outwardly away from the pool. This wall 190 is extruded integrally with a rearwardly extending wall portion 196 which in turn is extruded integrally with a downwardly extending wall portion 198. The walls 190 and 198 terminate at their lower edges in a pair of inwardly directed flanges 200 adapted to snap over the springy tongues of the springy connector means 186 in precisely the manner described above in connection with the flanges 56 and the springy connector means 60. In this way the concrete retainer means 188 can be readily assembled with the outer upper portion of the gutter estrusion in the manner shown most clearly in FIG. 6.

With the parts thus assembled and with suitable supports such as blocks or the like situated at given intervals beneath the gutter extrusion 122 so as to temporarily support the latter at the required elevation, the concrete 182 is poured so as to assume the configuration shown in FIG. 6, and the upper surface 200 which forms the concrete deck is inclined downwardly and outwardly to form a continuation of the upper surface of the wall 192 of the concrete retainer means 188. In this way the concrete deck will be pitched properly so as to cause any water or rain which falls on the deck surface 200 to flow outwardly away from the pool. The wall 192 is the region where an individual will stand preparatory to jumping into the pool, for example. Of course any diving board can be mounted adjacent the pool of the deep end thereof.

As may be seen from FIG. 15, when the parts are assembled, the components such as the cover extrusions 158, the concrete retainer extrusions 188, and the gutter extrusions 122 are suitably mitered so as to butt against each other at the corners in the manner illustrated in FIG. 15. Prior to pouring of the concrete suitable tape may be placed across the mitered connections to hold them together in sealed relation while the concrete sets, and thereafter this tape may be removed if desired.

Figure 16:
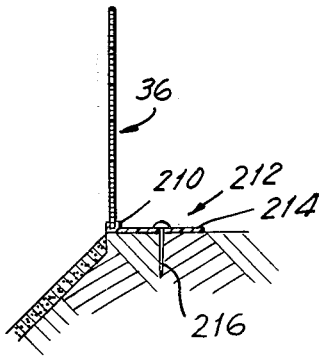
FIG. 16 is a view similar to FIG. 2 showing further anchoring structure.

In order to maintain the several units of the backing means prefectly stationary, so as to reliably prevent any buckling due to loads on the backing means, additional anchoring structure can be provided as shown in FIGS. 1 and 16. Thus, as is shown in FIG. 16, the lower edge of a unit of the backing means is received in an upwardly directed U-shaped channel 210 of an additional backing unit 212 which has a wall 214 integral with and forming an extension of the wall which extends between the upwardly directed parts of the U-shaped channel 210. Several of these additional anchoring units 212 can be arranged around the pool substantially centrally of each backing unit, as shown in FIG. 1, although additional components 212 may be utilized as desired. With the lower ends of the units of the backing means situated in the channels 210 of the additional anchoring devices 212, suitable anchoring pins, stakes, or the like 216 are driven into the ground as shown in FIG. 16, and thus each of the backing units 36 may be additionally secured to the ground in a highly reliable manner by the additional anchoring means 212.

Furthermore, it is not essential to utilize the springy tongues in the connecting means for connecting the several extrusions described above one to the next. Thus as may be seen from FIG. 17, where a pair of the extrusions 48 are fragmentarily illustrated, it is clear that these extrusions are each provided at their lower ends with the elongated inwardly directed flanges 56, as described above. However, the upper end strip 58 of each extrusion 48 does not carry the curved springy tongues. Each upper end strip 58 is, however, formed with the vertical ribs 62 and the outwardly directed flanges 64 which extend therefrom as described above.

Figure 17:
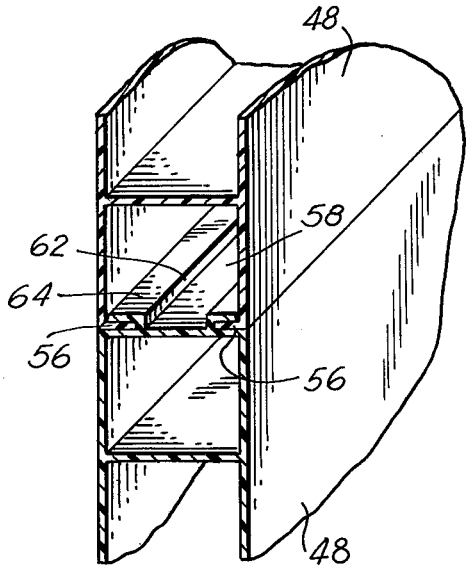
FIG. 17 is a sectional elevation fragmentarily illustrating another embodiment of a structure for connecting backing extrusions one to the next.

Thus, with this construction the connecting means between the pair of extrusions 48 shown in FIG. 17 includes only what amounts to a tongue-and-groove connection in that the lower ends of the extrusions are provided with the inwardly directed flanges 56 forming the tongues while the L-shaped parts 62, 64 define grooves with the upper end strip 58 receiving the tongues 56. With this construction it is a simple matter to slide one of the extrusions 48 longitudinally with respect to the other so that the tongues 56 will be received in the grooves defined by the L-shaped portions 62, 64 with the upper end strip 58. If desired, however, the tongues 56 may be covered with a suitable silicone material or the like which will greatly reduce the friction of the sliding contact when the tongues are introduced into these grooves.

Figure 18:
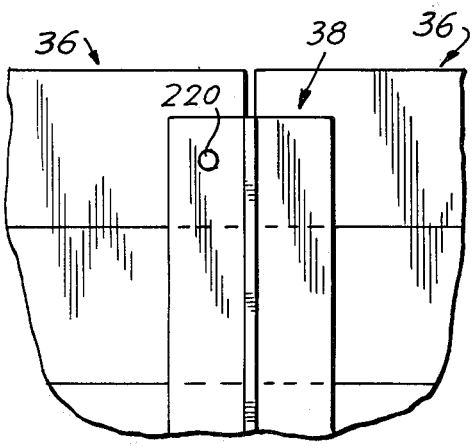
FIG. 18 is a fragmentary elevation illustrating part of a structure utilized during erection of the pool to maintain the units of the backing means at proper elevations.

The above-described structure of the invention lends itself to an extremely precise assembly in a highly simple and highly effective manner. Thuus, referring to FIG. 18, there are illustrated therein a pair of adjoining backing units 36 interconnected by a connecting means 38 as described above. Assuming that the right unit 36 of FIG. 18 is set and that the left unit 36 of FIG. 18 is to be properly positioned, then the operator will raise the left unit 36 of FIG. 18 until it has the proper elevation with respect to the right unit 36 of FIG. 18, where the top edges thereof are at precisely the same elevations. This raising can be done with a suitable crowbar, or the like, with one worker raising or lowering the left unit 36 while another worker checks on the elevation thereof through a suitable sight well known in civil engineering operations. Precisely when the left unit of FIG. 18 has the proper elevation, a worker will drive through a flange of the connector means 38 and into the left unit 36 a screw, pin, or the like 220, as shown in FIG 18, and through this simple quick and highly convenient expedient it is possible to retain each unit 36 at precisely the required elevation during the assembly of the pool.

Figure 19:
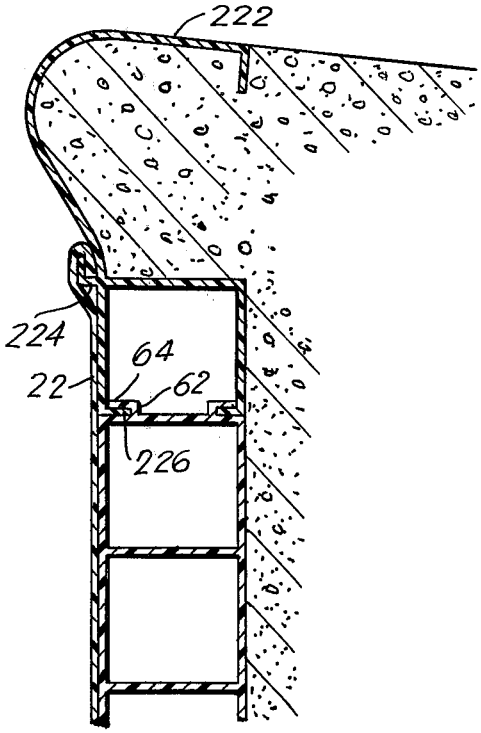
FIG. 19 is a fragmentary sectional elevation showing a connecting structure as illustrated in FIG. 17 utilized in connection with a concrete retainer as well as illustrating another type of structure for connecting the liner sheet to the backing means.

As was pointed out above in connection with FIG. 17, the particular tongue-and-groove type of connecting means illustrated therein can be used as a connecting means between any of the extruded components which require connection one to the next. Thus FIG. 19 shows an embodiment where the concrete retainer 222 is identical with an above-described concrete retainer except for differences noted below, this concrete retainer 222 having at its lower end the inwardly directed tongues 226 which are received in grooves formed by the L-shaped portions 62, 64 described above in connection with FIG. 17. Thus with the embodiment of FIG. 19 the concrete retainer 222 can be directly connected to the upper unit 48 of a backing means 36, without utilizing a gutter as described above. Of course with an arrangement of this type it will be necessary to utilize a skimmer opening.

With an arrangement as shown in FIG. 19, the liner sheet 22 will have its thicker, beaded edge simply received in a groove formed by a L-shaped part 224 which is extruded integrally with the concrete retainer 222. Thus the part 224 has a horizontal leg and a vertical leg extending therefrom, and these legs define with the inner surface of the concrete retainer 222 a groove to receive the upper edge of the liner sheet 22 as illustrated in FIG. 19. Through this simple construction it is possible to reliably mount the liner sheet 22 with a backing means and concrete retainer structure as shown in FIG. 19, providing in this way an exceedingly simple inexpensive pool construction.

Thus, as may be seen from FIG. 19, the plastic backing means which engages the outer surface of the liner sheet 22 has operatively connected to an upper region thereof the concrete-retaining means 222 which forms an extension of the plastic backing means and which is hollow so as to be capable of receiving concrete, as illustrated, this concrete-retaining means curving from the plastic backing means first inwardly and upwardly and then rearwardly and slightly downwardly so as to form a coping configuration, as illustrated in FIG. 19, extending upwardly and inwardly from the inner surface of the plastic backing means which engages the outer surface of the liner sheet 22. The structure 224 forms integrally with the concrete-retaining means 222 a grooved wall structure for receiving the upper edge of the liner sheet.

Furthermore, it is not essential to arrange the extrusions 48 of the backing means 36 so that they extend horizontally. Thus, referring to FIG. 20 it will be seen that it is also possible in accordance with the invention to arrange the extrusions 48 vertically. Thus, in FIG. 20 the several extrusions 48 are identical with those described above and are connected one to the next in precisely the same way. However, these extrusions are set up vertically rather than horizontally. The several units 36' made up in this case of vertically arranged units 48 are connected one to the next in precisely the manner described above by way of a series of connector means, one of the connector means 38 being shown in FIG. 20, and this connector means is anchored in precisely the manner described above.

Figure 20:
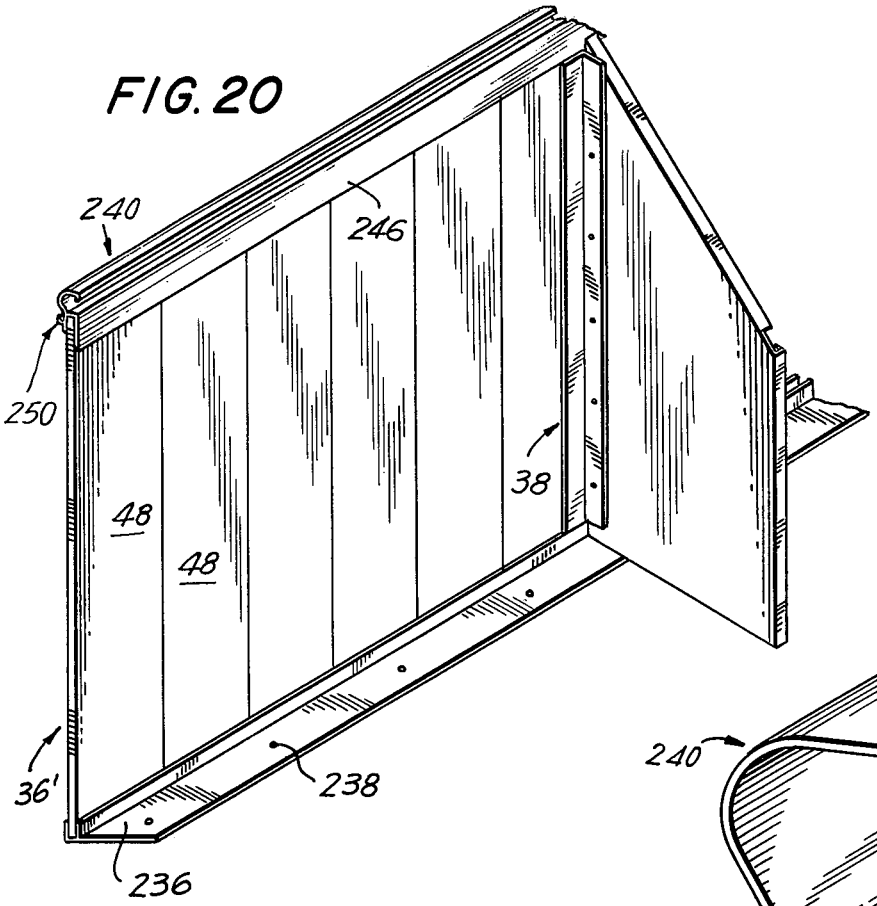
FIG. 20 is a perspective fragmentary elevation showing another embodiment of a backing means according to the invention.
Figure 22:
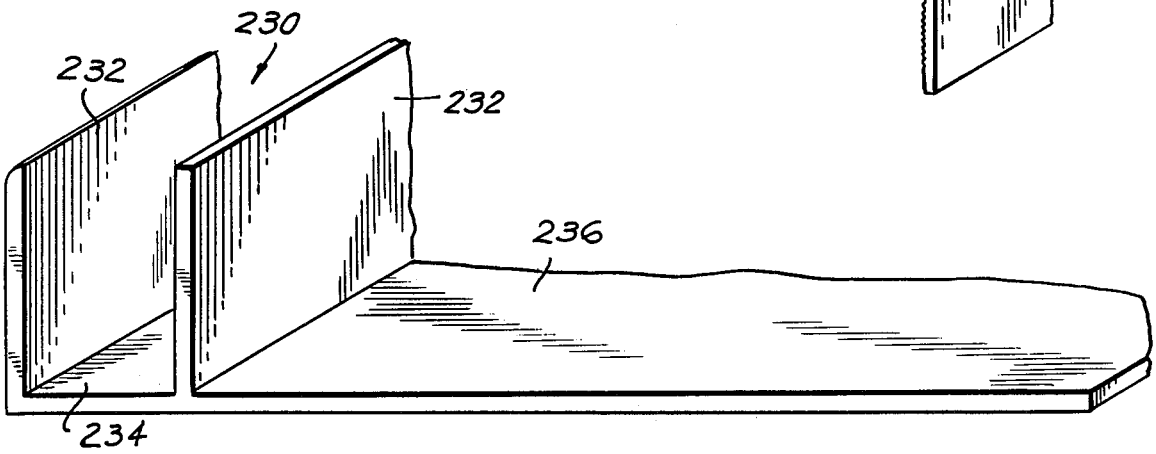
FIG. 22 is a fragmentary perspective illustration of a structure used in the assembly of FIG. 20 at the lower part thereof.

However, in order to accommodate the vertically arranged extrusions 48 of each unit 36', the lower ends of the extrusions 48 are received in an upwardly directed channel 230 defined between a pair of spaced parallel vertical walls 232 and by a horizontal wall 234 which has an extension 236 extending outwardly away from the interior of the pool, as illustrated in FIG. 20. The details of this structure are shown at an enlarged scale in FIG. 22. Thus, the structure shown in FIG. 22 is identical with the additional anchoring means 212 described above in connection with FIGS. 1 and 16, except that in the case of FIGS. 20 and 22 the channel structure and rearwardly extending wall 236 extends along the entire length of each unit 36', this structure shown in FIG. 22 being itself in the form of a suitable extrusion cut to the required length. The wall 236 is securely anchored by way of a plurality of stakes 238 driven through the wall 236 into the ground. In this way the bottom ends of the vertically extending extrusions 48 of each backing unit 36' are securely anchored.

Figure 21:
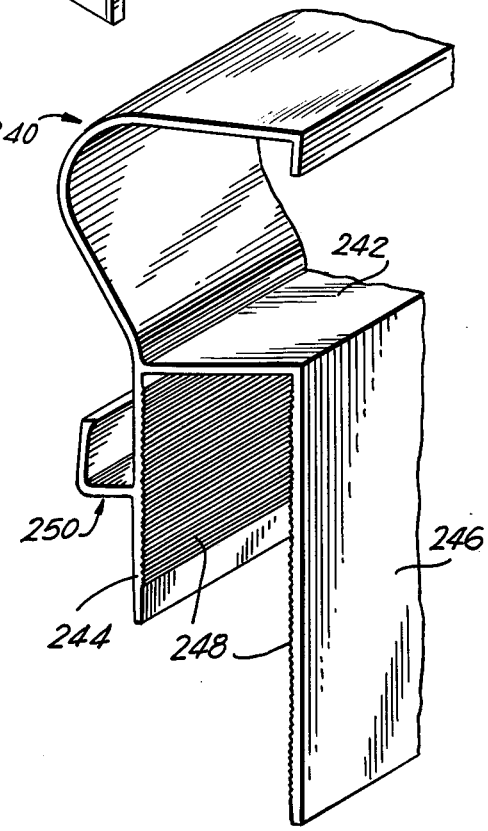
FIG. 21 is a fragmentary perspective illustration of a concrete retaining and liner sheet holding structure used with the embodiment of FIG. 20.

The top ends of the extrusions 48 of each backing unit 36' are connected with a concrete retainer means 240, shown fragmentarily in FIG. 21 and providing an assembly similar to that shown in FIG. 19. Thus, the concrete retaining means 240 of FIG. 21 is identical with that of FIG. 19 except that the horizontal wall portion 242 covers and is located next to the top open ends of the vertically arranged extrusions 48. This wall 242 is extruded integrally with an inner wall 244 and an outer wall 246 which is longer than the wall 244 as illustrated. These walls 244 and 246 together with the wall 242 define a channel which receives the top ends of the extrusions 48. In order to enhance the security of the connection, the inner surfaces of the walls 244 and 246 are formed with grooves and ribs 248, by suitably constructing the extrusion die, so that a secure tight connection will be achieved by reason of this construction.

The wall 244 which overlaps the front surfaces of the extrusions 48 which are directed inwardly toward the interior of the pool is integrally formed with a L-shaped extension 250 similar to the L-shaped extension 224 of FIG. 19 and serving in exactly the same way to receive the top edge of the liner sheet 22.

Thus, with this construction it is possible to provide in a simple economical manner as described above in connection with FIG. 19 a pool construction where the several extrusions 48 of each unit of the backing means extend vertically rather than horizontally.

It is therefore apparent that with the above-described structure of the invention it is possible to manufacture complete swimming pools almost entirely of extruded components which can be readily assembled without the use of tools in a highly convenient manner. The only parts which are not in the form of plastic extrusions are the components of the anchoring means 40 as described above and shown in FIGS. 2 and 3. In this way it is possible to keep the cost of the pool relatively low and in addition the extruded components are of a light weight and can be easily shipped to any desired location at low cost. The labor requirements at the site are considerably reduced as compared to the labor required with conventional pools. Also, the time required for setting up a pool according to the invention is far less than that required with conventional pools.

It will be noted that with the above described embodiments of the invention, the units of the backing means are all of a hollow construction. As a result air spaces are maintained in the backing structure situated behind the liner sheet. These air spaces form a highly effective thermal insulation so that the temperature of the water in the pool is maintained more uniform than would be the case if these insulating air spaces were not provided.

What is claimed is:

1. In a swimming pool, a plastic liner sheet having an inner surface defining the interior of the pool and an outer surface directed away from the interior of the pool, substantially rigid plastic backing means engaging said sheet at the outer surface thereof and forming a backing for said sheet, and concrete-retaining means operatively connected with an upper region of said plastic backing means and being composed of a plastic sheet material which extends from said upper region of said plastic backing means first upwardly and inwardly and then rearwardly and outwardly where said concrete-retaining means has an upper wall which is inclined slightly downwardly as well as rearwardly with said concrete-retaining means forming a hollow space capable of receiving concrete, and said concrete-retaining means having at the region where it extends upwardly and inwardly from said plastic backing means a wall structure integral with the concrete-retaining means and defining a groove for receiving an upper edge region of said plastic liner sheet.

2. The combination of claim 1 and wherein said plastic backing means includes a plurality of units arranged one next to the other along the periphery of the pool.

3. The combination of claim 2 and wherein said units are straight.

4. The combination of claim 2 and wherein at least some of said units are curved so that the pool has a configuration which is at least partially curved.

5. The combination of claim 2 and wherein each of said units includes a plurality of extrusions situated one above the other and connected one to the next.

6. The combination of claim 5 and wherein each extrusion is hollow and has an inner wall engaging said outer surface of said liner sheet and an outer wall spaced from and parallel to said inner wall, and each extrusion including a plurality of connecting strips situated one above the other between said inner and outer walls and being integral therewith.

7. The combination of claim 6 and wherein said strips are parallel to each other and perpendicular with respect to said inner and outer walls.

8. In a swimming pool, a plastic liner sheet having an inner surface defining the interior of the pool and an outer surface directed away from the interior of the pool, and substantially rigid plastic backing means engaging said sheet at the outer surface thereof and forming a backing for said sheet, said plastic backing means including a plurality of units arranged one next to the other along the periphery of the pool, each of said units including a plurality of extrusions situated one above the other and connected one to the next, each extrusion being hollow and having an inner wall engaging said outer surface of said liner sheet and an outer wall spaced from and parallel to said inner wall, and each extrusion including a plurality of connecting strips situated one above the other between said inner and outer walls and being integral therewith, said inner and outer walls of each extrusion terminating at their lower ends in inwardly directed flanges which are spaced from each other, one of said strips forming an upper end strip of each extrusion and extending between and being connected to upper edges of said inner and outer walls of each extrusion, and said upper end strip of each extrusion having an upper surface fixed with a springy connecting means for connecting each extrusion of each unit to the inwardly directed flanges of the next upper extrusion.

9. The combination of claim 8 and wherein said springy connecting means of each extrusion includes a pair of springy tongues extending along and being integral with each of the upper end strips, said pair of springy tongues having a pair of lower ribs extending vertically from each upper end strip, a pair of horizontally extending outwardly directed portions extending away from each other respectively from said ribs and defining with the upper surface of each upper end strip a groove for receiving a flange of the next higher extrusion, and a pair of upwardly and inwardly curved free portions extending toward each other from outer edges of said outwardly directed portions and having upwardly directed convex surfaces enabling the inwardly directed flanges of one extrusion to be pressed around said tongues with the latter yielding until said flanges snap into said grooves.

10. The combination of claim 2 and wherein a plurality of connector means are respectively situated between and connected with each pair of successive units for connecting said units one to the next.

11. The combination of claim 10 and wherein each of said connector means includes a pair of channels respectively receiving end regions of a pair of successive units.

12. The combination of claim 11 and wherein each channel includes a pair of parallel walls between which an end region of a unit is located and an inner transverse surface extending between said parallel walls and directed toward and located next to an end of a unit.

13. The combination of claim 12 and wherein said channels are oppositely directed and have between themselves a common wall having oppositely directed surfaces which form said inner surfaces of said channels.

14. The combination of claim 12 and wherein said channels are at right angles to each other with said connector means forming a corner of the pool, and said inner surfaces forming part of a pair of transverse channel walls which are perpendicular to each other.

15. The combination of claim 14 and wherein said corner connector means includes extensions of outer channel walls which intersect each other and form a hollow tubular part of said corner connector means, and the latter having an inner fillet wall extending between inner channel walls of the corner connector unit.

16. The combination of claim 15 and wherein a reinforcing flange extends outwardly away from the intersection between the extensions of said outer walls.

17. The combination of claim 11 and wherein each connector means has a vertically extending outwardly directed flange situated between said channels, and anchoring means operatively connected with said flange for anchoring said connector means.

18. The combination of claim 2 and wherein each unit has an upper end carrying an upper connecting means for connecting an upper edge region of the liner sheet fluidtightly to each unit.

19. The combination of claim 18 and wherein each upper connecting means of each unit includes a hollow upper extrusion having an inner wall engaging the outer surface of said liner sheet and an outer wall directed away from said sheet, said extrusion having an upper wall extending between said inner and outer walls and defining between said inner and outer walls a longitudinal groove for receiving an edge region of the liner sheet with the latter extending from said groove forwardly along said upper wall between said groove and inner wall of said extrusion and then downwardly along said inner wall, said upper connecting means including a cover seated on said upper extrusion and having a tongue extending into said groove and wedged against said edge region of said liner sheet for holding the latter in said groove.

20. In a swimming pool, a plastic liner sheet having an inner surface defining the interior of the pool and an outer surface directed away from the interior of the pool, and substantially rigid plastic backing means engaging said sheet at the outer surface thereof and forming a backing for said sheet, said plastic backing means including a plurality of units arranged one next to the other along the periphery of the pool, each unit having an upper end carrying an upper connecting means for connecting an upper edge region of the liner sheet fluid-tightly to each unit, each upper connecting means of each unit including a hollow upper extrusion having an inner wall engaging the outer surface of said liner sheet and an outer wall directed away from said sheet, said extrusion having an upper wall extending between said inner and outer walls and defining between said inner and outer walls a longitudinal groove for receiving an edge region of the liner sheet with the latter extending from said groove forwardly along said upper wall between said groove and inner wall of said extrusion and then downwardly along said inner wall, said upper connecting means including a cover seated on said upper extrusion and having a tongue extending into said groove and wedged against said edge region of said liner sheet for holding the latter in said groove, said upper extrusion having at said groove a pair of opposed wall portions having inwardly directed side surfaces provided with beads of yieldable compressible plastic soften than the remainder of the upper extrusion, said sheet having a relatively thick edge region received in said groove and said tongue pressing against the beads at one side surface of said groove and pressing said edge region against the beads at the other side surface of said groove for deforming and compressing said beads to provide the fluid-tight connection which prevents water of the pool from becoming located between said sheet and backing means.

21. The combination of claim 20 and wherein said groove is inclined from the top wall of said extrusion inwardly and downwardly towand the interior of the pool.

22. In a swimming pool, a plastic liner sheet having an inner surface defining the interior of the pool and an outer surface directed away from the interior of the pool, and substantially rigid plastic backing means engaging said sheet at the outer surface thereof and forming a backing for said sheet, said plastic backing means including a plurality of units arranged one next to the other along the periphery of the pool, each unit having an upper end carrying a connecting means for connecting an upper edge region of the liner sheet fluidtightly to each unit, said connecting means forming part of an extrusion which includes a gutter situated outwardly of and being integral with said connecting means and into which water from the pool can overflow.

23. The combination of claim 22 and wherein said gutter has an outer upper region distant from said connecting means, and a concrete-retaining means connected with and extending upwardly from said outer upper region of said gutter.

24. The combination of claim 23 and wherein said concrete-retaining means is itself in the form of a plastic extrusion having a bottom end terminating in a pair of inwardly directed spaced flanges, said outer upper region of said gutter having a pair of springy tongues for releasably receiving and extending around said flanges to connect said concrete-retaining means to said gutter.

25. The combination of claim 22 and wherein a cover means is situated over and covers said gutter, said cover means having a front downwardly directed channel portion in which said connecting means is received, said channel portion overlapping an upper region of said liner sheet, and said cover means having a wall extending over said gutter and formed with openings through which water may flow through said wall into said gutter, said cover means terminating at an outer edge in a downwardly directed flange which engages an inner surface of the gutter.

26. In a swimming pool, a plastic liner sheet having an inner surface defining the interior of the pool and an outer surface directed away from the interior of the pool, and substantially rigid plastic backing means engaging said sheet at the outer surface thereof and forming a backing for said sheet, said plastic backing means including a plurality of units arranged one next to the other along the periphery of the pool, a plurality of channel units being situated between and receiving said units of said backing means for interconnecting the latter units, each unit of said backing means having an upper end region carrying a connecting means for connecting an upper edge region of the liner sheet fluid-tightly to each unit of said backing means, said connecting means being integral with a gutter surrounding and situated outwardly of all of said units and a concrete retainer unit connected with said gutter at an outer upper region thereof, and all of said units as well as said gutter and connecting means being made of plastic extrusions.

27. The combination of claim 26 and wherein a cover means is situated over and covers said gutter and is itself made also of a plastic extrusion.

28. The combination of claim 2 and wherein each of said units includes a plurality of extrusions situated one beside the other and connected one to the next.

29. The combination of claim 28 and wherein each extrusion is hollow and has an inner wall engaging said outer surface of said liner sheet and an outer wall spaced from and parallel to said inner wall, and each extrusion including a plurality of connecting strips situated one beside the other between said inner and outer walls and being integral therewith.

30. The combination of claim 2 and wherein each of said units includes a plurality of hollow extrusions situated one next to the other and a connecting means connecting the successive extrusions to each other, said connecting means including L-shaped strips defining grooves with one end of each extrusion and inwardly extending tongues carried by the adjoining extrusion to be received in said grooves.

31. The combination of claim 2 and wherein an anchoring means cooperates with each of said units for anchoring the same.

32. The combination of claim 5 and wherein said anchoring means includes an upwardly directed channel receiving a lower edge of each unit and a wall extending outwardly from and integrally formed with said channel and engaging the ground so that the latter wall can be anchored directly to the ground.

33. The combination of claim 10 and wherein a pin extends through a wall of a connector means and into a unit engaging the same for determining the elevation of said unit.

34. The combination of claim 2 and wherein a concrete-retaining means is operatively connected with an upper region of each of said units for retaining a concrete deck surrounding the pool.

35. In a swimming pool, a plastic liner sheet having an inner surface defining the interior of the pool and an outer surface directed away from the interior of the pool, and substantially rigid plastic backing means engaging said sheet at the outer surface thereof and forming a backing for said sheet, said plastic backing means including a plurality of units arranged one next to the other along the periphery of the pool, a concrete-retaining means being operatively connected with an upper region of each of said units for retaining a concrete deck surrounding the pool, said concrete retaining means having an inner wall provided with an inner surface directed toward the interior of the pool, and an extension of L-shaped cross section integrally formed with the latter wall and defining with said wall an upwardly directed groove for receiving a top edge of the liner sheet.

36. The combination of claim 35 and wherein said concrete retaining means defines a downwardly directed channel receiving an upper edge region of each unit.

37. The combination of claim 36 and wherein said channel includes at inner surface regions thereof elongated ribs for increasing the frictional connection and tightness between the concrete retaining means and each unit.

38. The combination of claim 35 and wherein the concrete retaining means has a lower end forming part of a connector means for releasably connecting the concrete retaining means with an upper end of each unit.

* * * * *